United States Patent [19]

McElroy

[11] Patent Number: 4,627,179

[45] Date of Patent: Dec. 9, 1986

[54] SHOCK ABSORBING INSOLE CONSTRUCTION

[75] Inventor: Benedict R. McElroy, Greencastle, Pa.

[73] Assignee: Action Products, Inc., Hagerstown, Md.

[21] Appl. No.: 753,694

[22] Filed: Jul. 10, 1985

[51] Int. Cl.[4] ..... A43B 13/40

[52] U.S. Cl. ..... 36/44; 36/71; 128/595; 428/314.8

[58] Field of Search ..... 36/44, 43, 71, 91; 12/146 B, 146 BR, 146 R; 128/581, 595, 614; 428/314.8, 316.6

[56] References Cited

U.S. PATENT DOCUMENTS

| | | | |
|---|---|---|---|
| 1,517,610 | 12/1924 | Bayless . | |
| 2,146,888 | 2/1939 | Fisch . | |
| 2,545,062 | 3/1951 | Whittington . | |
| 2,909,854 | 10/1959 | Edelstein . | |
| 3,143,812 | 8/1964 | Bittner . | |
| 3,624,930 | 12/1971 | Johnson et al. . | |
| 3,730,169 | 5/1973 | Fiber . | |
| 4,062,131 | 12/1977 | Hsiung | 36/44 |
| 4,268,980 | 5/1981 | Gudas . | |
| 4,345,387 | 8/1982 | Daswick . | |
| 4,541,184 | 9/1985 | Leighton | 36/44 |
| 4,541,186 | 9/1985 | Mulvihill | 36/44 X |

FOREIGN PATENT DOCUMENTS

| | | | |
|---|---|---|---|
| 1145932 | 5/1983 | Canada | 36/43 |
| 0117758 | 9/1984 | European Pat. Off. | 36/44 |

*Primary Examiner*—James Kee Chi

*Attorney, Agent, or Firm*—Joseph P. Gastel

[57] ABSTRACT

A shock absorbing insole construction including an upper layer of plastic material having a storage modulus which is about 100 times the storage modulus of a lower layer of material and both materials having a relatively high loss factor. In its more particular aspects, the upper layer is a poly(ethylene-vinyl acetate) and the lower layer is a viscoelastic polyurethane polymer.

15 Claims, 6 Drawing Figures

SHOCK ABSORBING INSOLE CONSTRUCTION

BACKGROUND OF THE INVENTION

The present invention relates to an improved insole construction having extremely high shock absorbing capabilities.

By way of background, numerous types of insoles have been used in the past. These insoles usually were fabricated from rubber, cork or polyurethane materials, and some prior insoles consisted of a plurality of layers of materials. However, prior insoles, even those comprising a plurality of layers, still transmitted a considerable amount of shock upwardly to the foot and beyond.

Studies have shown that the foot and lower leg are subjected to relatively large forces. In fact, it has been found that walking on a hard surface produces decelerations as high as 30 G in the heel of a hard leather shoe. The impacting shock waves transmitted to the foot during walking, jogging and engaging in sports, such as aerobics and racquet sports, are further transmitted upwardly through the flesh and bones of the body. Unabsorbed shock forces can contribute to various types of medical problems, such as shin splints, leg joint and hip problems and lower back pains. In addition, to vibrational shock forces, the feet are subjected to pressure and skin shear, the latter resulting from horizontal and rotational foot movements.

In the past it has been known that a viscoelastic material can absorb forces generated at the foot interface, and the use of such a material in the shoe improved both comfort and protection against related health problems. It is with an extension of the foregoing knowledge that the present invention is concerned.

SUMMARY OF THE INVENTION

It is one object of the present invention to provide an improved composite insole which absorbs shocks in different ranges to thereby prevent potentially damaging shocks from being transmitted upwardly from the sole of a shoe into the foot.

Another object of the present invention is to provide an improved composite multi-layer insole in which the layers have unique combinations of storage moduli, loss factors and frequency conversion, thereby resulting in a unique combination of great energy absorption by the two layers, with the net result that relatively little vibrational shock energy is transmitted to the foot, and what energy is transmitted is of a lower frequency which is easier for the body to dissipate. Other objects and attendant advantages of the present invention will readily be perceived hereafter.

The present invention relates to an insole construction comprising an upper layer of plastic material having a storage modulus of between about 500 and 2,000 psi/cycle and a lower layer of plastic material having a storage modulus of between about 5 and 99 psi/cycle.

The various aspects of the present invention will be more fully understood when the following portions of the specification are read in conjunction with the accompanying drawings wherein:

DESCRIPTION OF THE PREFERRED EMBODIMENTS

Figure 1:
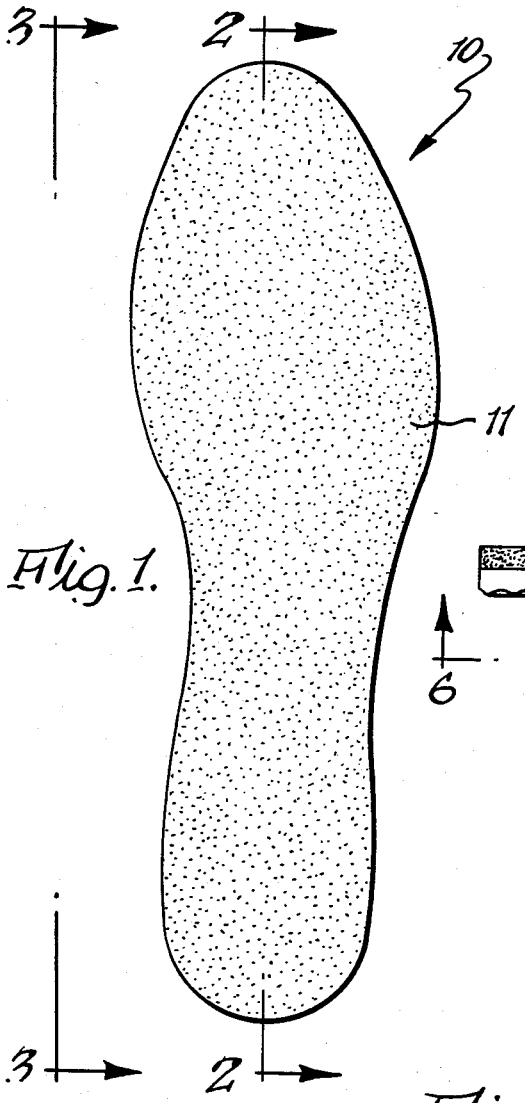
FIG. 1 is a plan view of an insole of the present invention.
Figure 3:
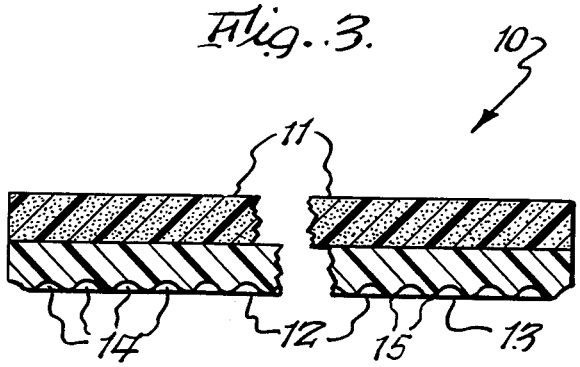
FIG. 3 is a fragmentary side elevational view taken substantially in the direction of arrows 3—3 of FIG. 1.
Figure 2:
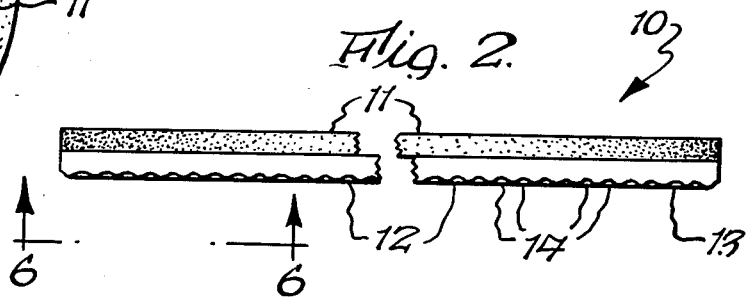
FIG. 2 is a fragmentary cross sectional view taken substantially along line 2—2 of FIG. 1.

The embodiment of FIGS. 1–3 includes an upper layer 11 of microporous poly(ethylene-vinyl acetate) and a lower layer 12 of viscoelastic polyurethane polymer suitably secured thereto by adhesive. The microporous poly(ethylene-vinyl acetate) is also known under the trademark ZEKON and the viscoelastic polyurethane polymer is also known under the trademark AKTON. Both of the foregoing are trademarks of Action Products, Inc. of Hagerstown, Md. The poly(ethylene-vinyl acetate) is also known under the trademark PROLITE of Monarch Rubber Company. The upper layer may also be a foamed semirigid polyurethane or a foamed polyethylene or a foamed polypropylene or any other suitable plastic material, any of which have the essential properties of storage modulus and loss factor set forth hereafter for the poly(ethylene-vinyl acetate).

The physical properties of the upper layer 11 may be as follows: The tensile strength may be between 90 and 1,000 psi and more preferably between 100 and 500 psi and most preferably between 200 and 400 psi. The elongation may be between 100% and 800% and more preferably 200% and 700% and most preferably between 300% and 500%. The storage modulus, psi/cycle at 72° F. may be between 500 and 2,000 and more preferably between 700 and 1,500, and most preferably between 900 and 1,200. The loss factor in percent may be between 50 and 99, and more preferably between 75 and 85 and most preferably between 85 and 95. The specific gravity may be between 0.15 and 0.50 and more preferably between 0.19 and 0.45 and most preferably between 0.20 and 0.40. The density in pounds per cubic foot may be between 10 and 30 and more preferably between 12 and 28 and most preferably between 13 and 25. The water absorption weight in percent (ASTMD-1056-78) may be between about 5 and 25, and preferably between about 5 and 100. The Shore 00 Durometer may be between 45 and 90 and more preferably between 50 and 85 and most preferably between 55 and 75. The compression in psi at 25% deflection (ASTMD-1056-78) may be between 15 and 40 and more preferably between 20 and 35 and most preferably between 18 and 30. The compression set in percent (ASTMD-1056-78) may be up to 25 maximum and more preferably up to 15 maximum and most preferably up to 8 maximum.

The lower layer 12 may have the following physical properties. The Shore 00 Durometer may be between 40 and 70, and more preferably between 42 and 65 and most preferably between 45 and 55. The specific gravity may be between 0.90 and 1.40, and more preferably between 0.95 and 1.10 and most preferably between 1.00 and 1.05. The stress at 200% elongation, psi, (ASTMD-412) may be between 10 and 80, and more preferably between 12 and 75 and most preferably between 15 and 60. The ultimate tensile strength, psi, (ASTMD-412) may be between 10 and 150, and more preferably between 12 and 100 and most preferably between 15 and 50. The tear strength, pounds/inch, (ASTMD-624) may be between 3 and 50, and more preferably between 4 and 25 and most preferably between 4 and 16. The elongation in percent (ASTMD-412) may be between 50 and 500, and more preferably between 75 and 400 and most preferably between 100 and 350. The storage modulus, psi/cycle at 72° F., may be between 10 and 85, and more preferably between 15 and 45 and most preferably between 10 and 20. The loss factor in percent may be between 50 and 99 and more preferably between 60 and 95 and most preferably between 85 and 95.

The upper layer 11 when used in combination with the lower layer 12 causes the insole to filter out high frequency and low frequency shock waves because of their outstanding properties for cushioning and dissipation of vibrational shock energy. However, the maximum effectiveness of each layer resides in different energy ranges. When the upper and lower layers are combined as a composite, the materials provide an insole which can prevent transmission to the foot of a very wide range of potentially damaging shock forces.

The upper layer 11 contributes high energy vibrational shock dissipation, stabilized foot flotation, skin shear reduction and moisture absorption. The lower layer 12 contributes low energy vibrational shock dissipation, cushioning without bottoming out, endless cyclic restoration, filtering of damaging high frequency shock waves to milder lower frequencies, and heat dissipation.

In its more specific aspects, the lower layer 12, being viscoelastic, acts as a fluid cushion and since it is softer than the upper layer, it will distort a relatively large amount before the upper layer distorts any appreciable amount. Essentially the composite insole 10 absorbs or cushions shock in two different ranges. The lesser shocks are absorbed by the lower layer 12 and the greater shocks are absorbed by both the lower layer 12 and the upper layer 11.

It is believed that the energy absorption action of the composite insole 10 is due to the unique combination of storage moduli and loss factors of the two components. As can be seen from the above table, the preferred storage modulus of the lower layer 12 is in the range of between 10 and 20 whereas the preferred storage modulus of the upper layer 11 is between 900 and 1,200. The preferred loss factor of both the upper and lower layers is between 85% and 95%. The storage modulus is generally defined as the amount of energy which can be bounced back toward its source, and the loss factor is broadly defined as the percent of the amount of energy absorbed which was put in. Since the loss factors of the preferred ranges of both the upper and lower layers are between 85% and 95%, both the upper layer and lower layer 12 absorb a very high percentage of the energy to which they are subjected and thus do not transmit it to the foot. Furthermore, any energy which does pass through the lower viscoelastic polyurethane layer 12 is bounced back by the upper layer 11 because of its very high storage modulus which is about 100 times that of the lower layer in the preferred ranges. The net result therefore is that by a combination of energy absorption in both the lower and upper layers and the bouncing back of energy by the upper layer, the transmission of shock forces to the foot is very low.

In addition to the foregoing, the upper layer 11 has a water absorption capacity to absorb moisture given off by the foot, thereby tending to keep it dry. The lower layer 11 has a heat absorption capacity, thereby tending to keep the foot cool. In addition, the lower surface 13 of the lower layer 12 has a knurled appearance which provides spaced concave depressions 14 between ridges 15 which cross each other. Thus, when the ridges 15 distort, they can expand laterally into the spaces of the concave depressions. The tendency to fill and empty the concave depressions produces an air pumping action as the foot flexes the lower layer of the insole.

Layers 12 and 13 are preferably approximately ⅛ of an inch thick. However, they can be made in different thickness ranges, as desired for different applications.

A specific example of an improved insole fabricated of an upper layer of ZEKON and a lower layer of AKTON 145 had the following properties:

| | ZEKON | AKTON 145 |
|---|---|---|
| Tensile strength psi | 300 | 28 |
| Elongation % | 480 | 350 |
| Stress at 200% elongation, psi | — | 18 |
| Storage modulus, psi/cycle @ 72° F. | 1023 | 12 |
| Loss factor, % | 89 | 89 |
| Specific gravity | 0.3 | 1.03 |
| Water absorption | 5% Maximum | — |
| Shore 00 Durometer | 70 | 45 |
| Tear strength #/in | — | 8 |

Figure 4:
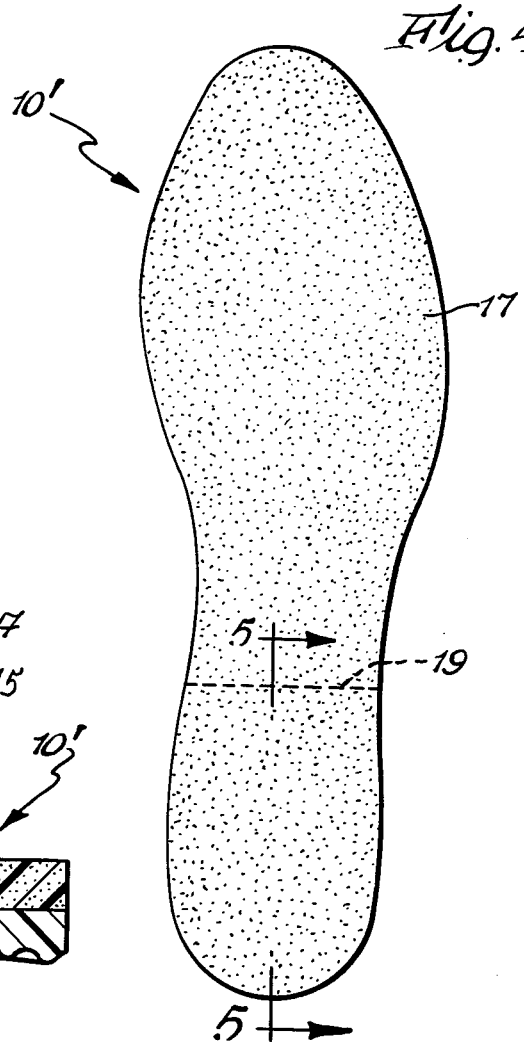
FIG. 4 is a plan view of a modified form of insole.
Figure 6:
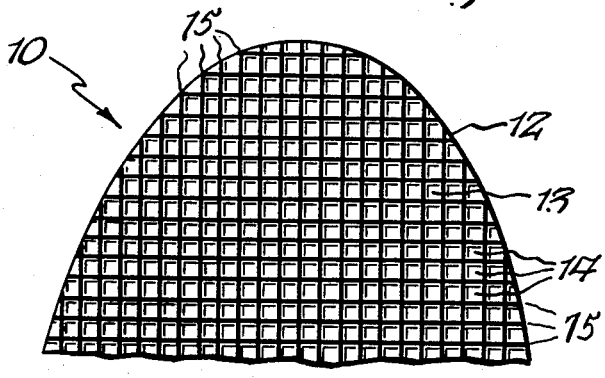
FIG. 6 is a fragmentary bottom plan view taken substantially in the direction of arrows 6—6 of FIG. 3.
Figure 5:
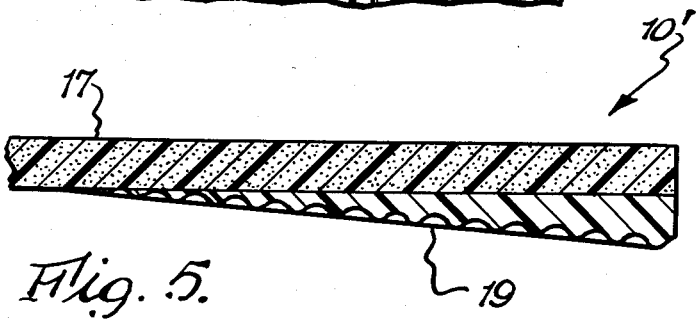
FIG. 5 is a fragmentary side elevational view taken substantially along line 5—5 of FIG. 4.

In FIGS. 4 and 5 a modified insole 10' is shown having a complete member 17 which is in the shape of a full insole. The material of member 17 is identical to the material of upper layer 11 of FIGS. 1-3. However, insole 10' has only a wedge member 19 at the heel to absorb shocks thereto. The material of wedge member 19 may be identical to the material of lower layer 12 described above relative to FIGS. 1-3 and 6. An insole of the type of FIGS. 4 and 5 can be used where the shock absorption is primarily to the heel and where the added benefit of the lower shock absorbing layer is not necessary at the remainder of the sole.

While the improved insole of the present invention has been depicted as one which can be inserted into a shoe, it will be appreciated that it can be incorporated into a shoe as an integral insole.

If the test methods are not specifically stated relative to any of the properties of any of the layers described above, it will be understood that they are obtained by the same test methods specifically referred to in other parts of the specification.

While preferred embodiments of the present invention have been disclosed, it will be appreciated that it is not limited thereto, but may be otherwise embodied within the scope of the following claims.

What is claimed is:

1. An insole construction comprising an upper layer of plastic material having a storage modulus of between about 500 and 2,000 psi/cycle and a lower layer of viscoelastic polyurethane material having a storage modulus of between about 10 and 85 psi/cycle and a specific gravity of between about 0.95 and 1.10.

2. An insole construction as set forth in claim 1 wherein both said upper layer and lower layer have a loss factor of between about 50 and 99.

3. An insole construction as set forth in claim 1 wherein said upper layer has a storage modulus of between about 700 and 1,500 psi/cycle and wherein said lower layer has a storage modulus of between about 15 and 45 psi/cycle.

4. An insole construction as set forth in claim 3 wherein said upper layer has a loss factor of between about 75 and 85, and said lower layer has a loss factor of between about 60 and 95.

5. An insole construction as set forth in claim 1 wherein said upper layer has a storage modulus of between about 900 and 1,200 psi/cycle and wherein said lower layer has a storage modulus of between about 10 and 20 psi/cycle.

6. An insole construction as set forth in claim 5 wherein both said upper layer and lower layer have a loss factor of between about 85 and 95.

7. An insole construction as set forth in claim 5 wherein said upper layer has a tensile strength of between about 200 and 400 psi, and an elongation of between about 300% and 500%, and a Shore 00 Durometer of between about 55 and 75.

8. An insole construction as set forth in claim 7 wherein said lower layer has a tear strength of between about 4 and 16 lbs/in, and an elongation of between about 100% and 350% and a Shore 00 Durometer of between about 45 and 55.

9. An insole construction as set forth in claim 5 wherein said lower layer has a tear strength of between about 4 and 25 lbs/in, and an elongation of between about 75% and 400% and a Shore 00 Durometer of between about 42 and 65.

10. An insole construction as set forth in claim 1 wherein said upper layer is a microporous poly(ethylene-vinyl acetate) material and wherein said lower layer is a viscoelastic polyurethane polymer.

11. An insole construction comprising a lower layer of viscoelastic polyurethane polymer having a specific gravity of between about 0.95 and 1.10 and an upper layer of microporous poly(ethylene-vinyl acetate).

12. An insole construction as set forth in claim 11 wherein said upper layer and lower layer extend substantially throughout the entire extent of said insole.

13. An insole construction as set forth in claim 11 wherein said insole includes a sole portion and a heel portion and wherein said lower layer is located only at said heel portion of said insole.

14. A pad for installation as the insole of a shoe comprising an upper layer of plastic material having a storage modulus of between about 500 and 2,000 psi/cycle and a lower layer of viscoelastic polyurethane material having a storage modulus of between about 10 and 85 psi/cycle and a specific gravity of between about 0.95 and 1.10.

15. An insole construction comprising a lower layer of viscoelastic polyurethane having a specific gravity of between about 0.95 and 1.10 and an upper layer selected from the group of microporous poly(ethylene-vinyl acetate) and foamed semirigid polyurethane and foamed polypropylene and foamed polyethylene.

* * * * *